US012752895B1

(12) United States Patent
Stajkowski

(10) Patent No.: US 12,752,895 B1
(45) Date of Patent: Oct. 6, 2026

(54) WATERCRAFT ASSEMBLIES AND METHODS

(71) Applicant: Steve Stajkowski, Lewiston, ID (US)

(72) Inventor: Steve Stajkowski, Lewiston, ID (US)

( * ) Notice: Subject to any disclaimer, the term of this patent is extended or adjusted under 35 U.S.C. 154(b) by 460 days.

(21) Appl. No.: 18/198,133

(22) Filed: May 16, 2023

Related U.S. Application Data

(60) Provisional application No. 63/342,558, filed on May 16, 2022.

(51) Int. Cl.
*B63H 11/01* (2006.01)
*B63B 1/04* (2006.01)

(52) U.S. Cl.
CPC ..... *B63H 11/01* (2013.01); *B63B 1/042* (2013.01)

(58) Field of Classification Search
CPC ..... B63H 11/00; B63H 11/01; B63B 1/042
USPC ..... 440/38, 46
See application file for complete search history.

(56) References Cited

U.S. PATENT DOCUMENTS 3,253,567 A * 5/1966 Patton, Jr. ..... B63H 11/01 440/46
5,690,520 A * 11/1997 Rheault ..... B63B 59/08 440/46
5,876,258 A * 3/1999 Gray ..... B63H 11/08 440/46
5,989,083 A * 11/1999 Ishigaki ..... B63H 11/11 440/46
6,083,063 A * 7/2000 Neisen ..... B63H 11/01 440/46
6,482,055 B1 * 11/2002 Freitag ..... B63H 11/01 440/46
7,377,826 B1 * 5/2008 Wengren, Jr. ..... B63H 11/01 440/46
8,007,329 B2 * 8/2011 Wengren, Jr. ..... B63H 11/01 440/46
11,097,821 B1 * 8/2021 Schultz ..... B63H 11/01

* cited by examiner

*Primary Examiner* — Daniel V Venne
(74) *Attorney, Agent, or Firm* — Wells St. John P.S.

(57) ABSTRACT

Watercraft assemblies are provided that can include: a watercraft hull having a keel opening configured to receive intake for a water propulsion motor; and a tunnel assembly between the motor and the keel opening, the tunnel assembly configured to couple the water propulsion watercraft motor intake with the watercraft hull at an angle other than parallel with the watercraft hull. Watercraft assemblies are also provided that can include a hinged grate assembly operably engaged about the intake.

Watercraft water propulsion motor intake clearing methods are provided that can include extending push rods through a stern platform to extend a hinged grate away from an intake of the water propulsion motor.

7 Claims, 19 Drawing Sheets

WATERCRAFT ASSEMBLIES AND METHODS

CROSS REFERENCE TO RELATED APPLICATION

This application claims priority to and the benefit of U.S. Provisional Patent Application Ser. No. 63/342,558 filed May 16, 2022, entitled "Watercraft Assemblies", the entirety of which is incorporated by reference herein.

TECHNICAL FIELD

The field of the invention is watercraft assemblies, particularly jet powered watercraft assemblies that utilize jet power, and even more particularly, watercraft assemblies that utilize hull intake jet power.

BACKGROUND

The present disclosure relates to watercraft assemblies, particularly watercraft assemblies that utilize jet power. In current jet power watercraft assemblies, it is desirable to utilize jet powered watercraft in areas that are very low or shallow depth. Accordingly, the intakes of the jet powered watercraft can become clogged with debris and/or the jet powered watercraft may need to utilize motors and/or intake assemblies designed to deal with this debris in these lower depth areas. The present disclosure provides assemblies and methods for powering watercraft with jet intakes that overcome the problems associated with the prior art.

SUMMARY

Watercraft assemblies are provided that can include: a watercraft hull having a keel opening configured to receive intake for a water propulsion motor; and a tunnel assembly between the motor and the keel opening, the tunnel assembly configured to couple the water propulsion watercraft motor intake with the watercraft hull at an angle other than parallel with the watercraft hull.

Watercraft assemblies are also provided that can include a hinged grate assembly operably engaged about the intake.

Watercraft water propulsion motor intake clearing methods are provided that can include extending push rods through a stern platform to extend a hinged grate away from an intake of the water propulsion motor.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Figure 1:
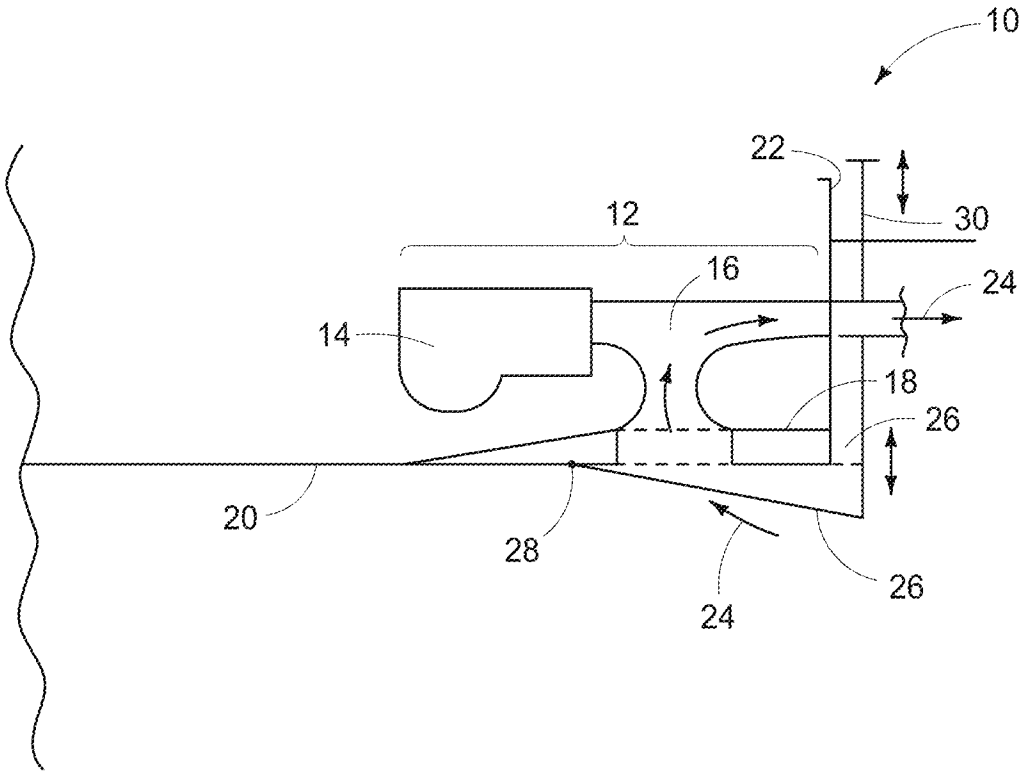
FIG. 1 is a watercraft assembly according to an embodiment of the disclosure.

The present disclosure will be described with reference to FIGS. 1-17. Referring first to FIG. 1, a watercraft assembly 10 is shown that includes a motor intake assembly 12 that includes a motor 14 and an intake 16 operably coupled to a hull 20 via tunnel assembly 18. In accordance with example implementations, the motor intake can be arranged in relation to a stern 22 of watercraft 10. As shown, tunnel assembly 18 extends from a bow end of the watercraft to stern 22. In accordance with example implementations, tunnel assembly 18 can provide a support or rise to intake 16 and thereby also a rise to motor 14. In accordance with example implementations, the motor may include and likely will include an oil pan section, and this oil pan section can be cleared by a portion or made room for by a portion of tunnel assembly 18. In accordance with example implementations, watercraft 10 can also include a debris clearance assembly that can include grate 26 which is moveable between two positions; a first position as shown in dark, and a dashed position 16 as shown, and grate 26 can engage with hull or tunnel assembly 18 via a pivot mount 28 (hinged end). In accordance with example implementations, grate 26 can be operably engaged between an upright and clearing position via a biased stomp (pedal) 30 or 110 which can be used via foot or hand to move grate 26 between a clearing position and a running position. In accordance with example implementations, the biased stomp 30 can be biased in the running position. Stomp 30 can include one or more push rods that are biased away from a stern platform that they extend through. The biasing members 211 can include one or more springs for example.

Figure 2:
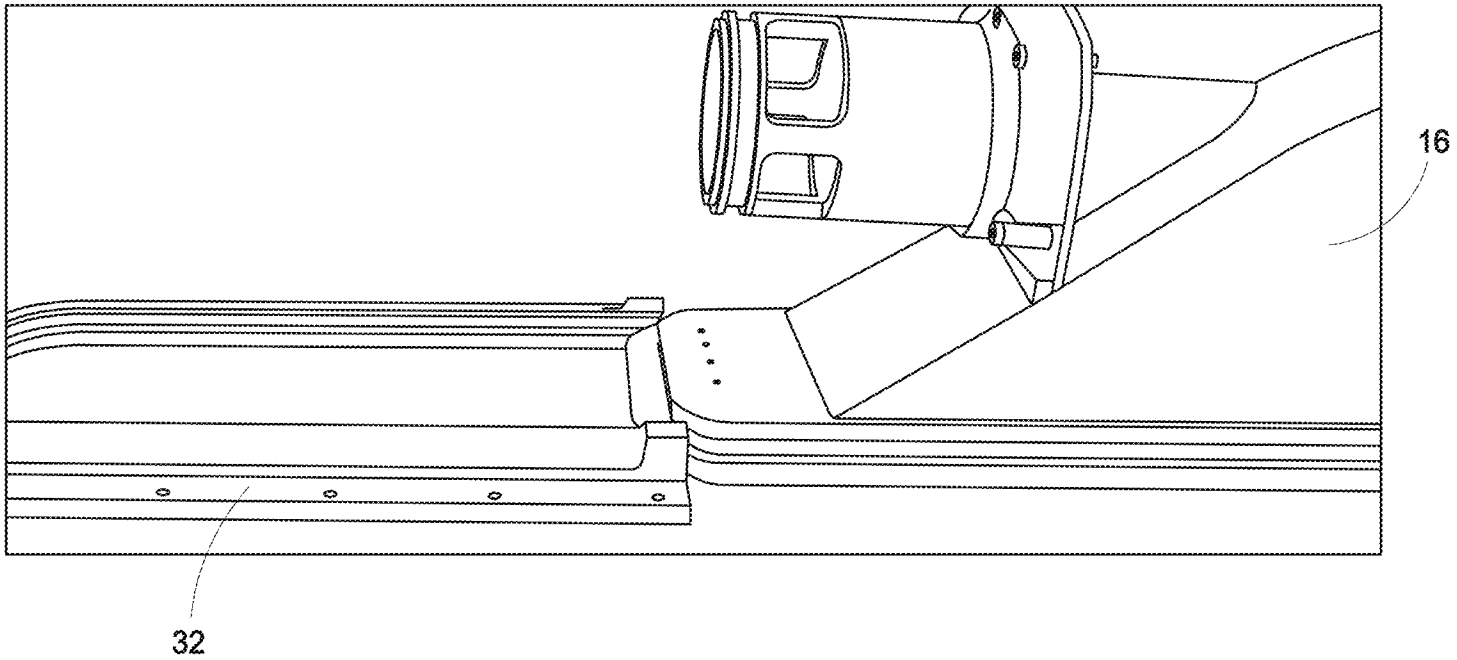
FIG. 2 is a depiction of a jet intake and an intake mount according to an embodiment of the disclosure.
Figure 3:
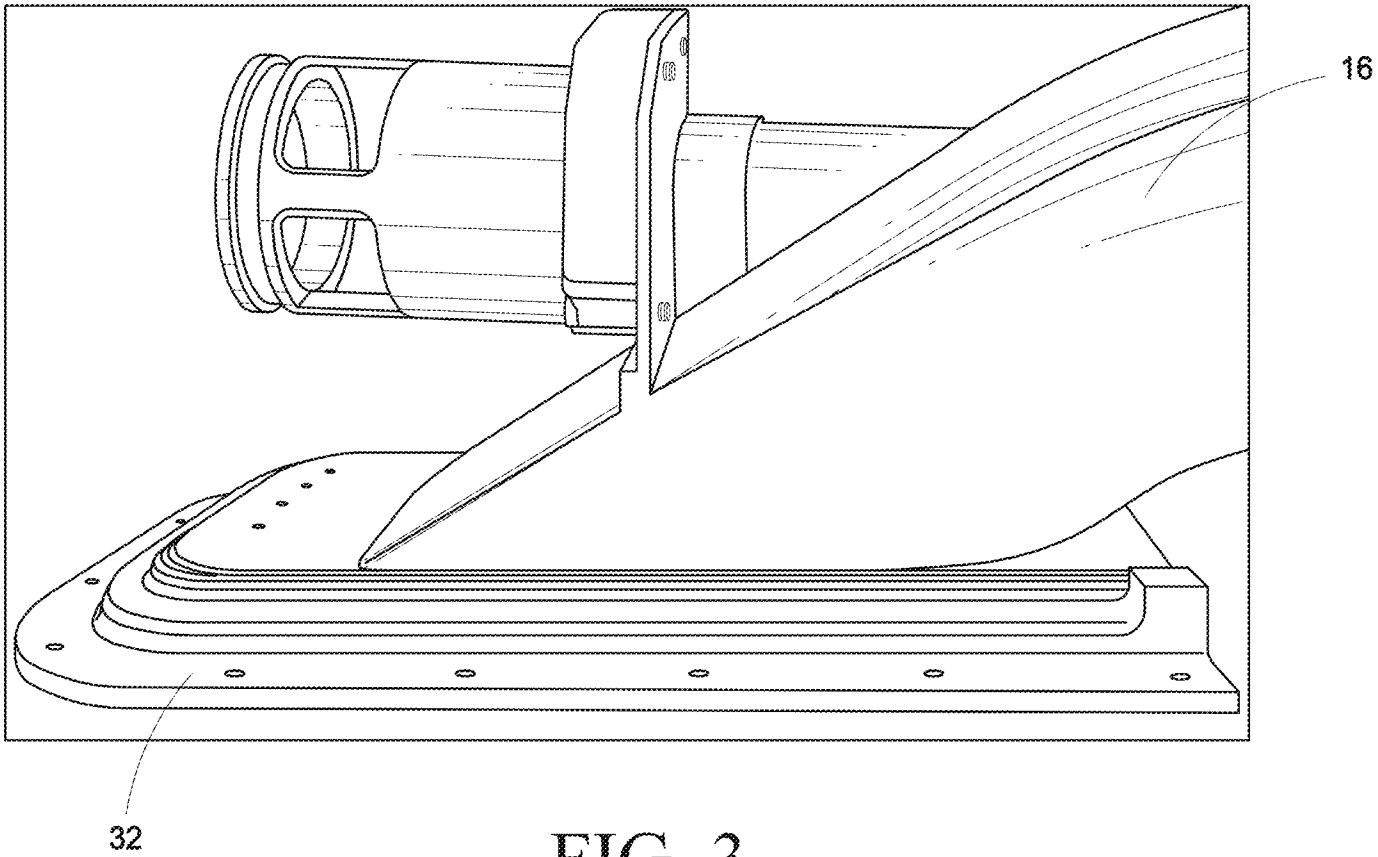
FIG. 3 is a depiction of a jet intake coupled to a jet intake mount according to an embodiment of the disclosure.
Figure 4A:
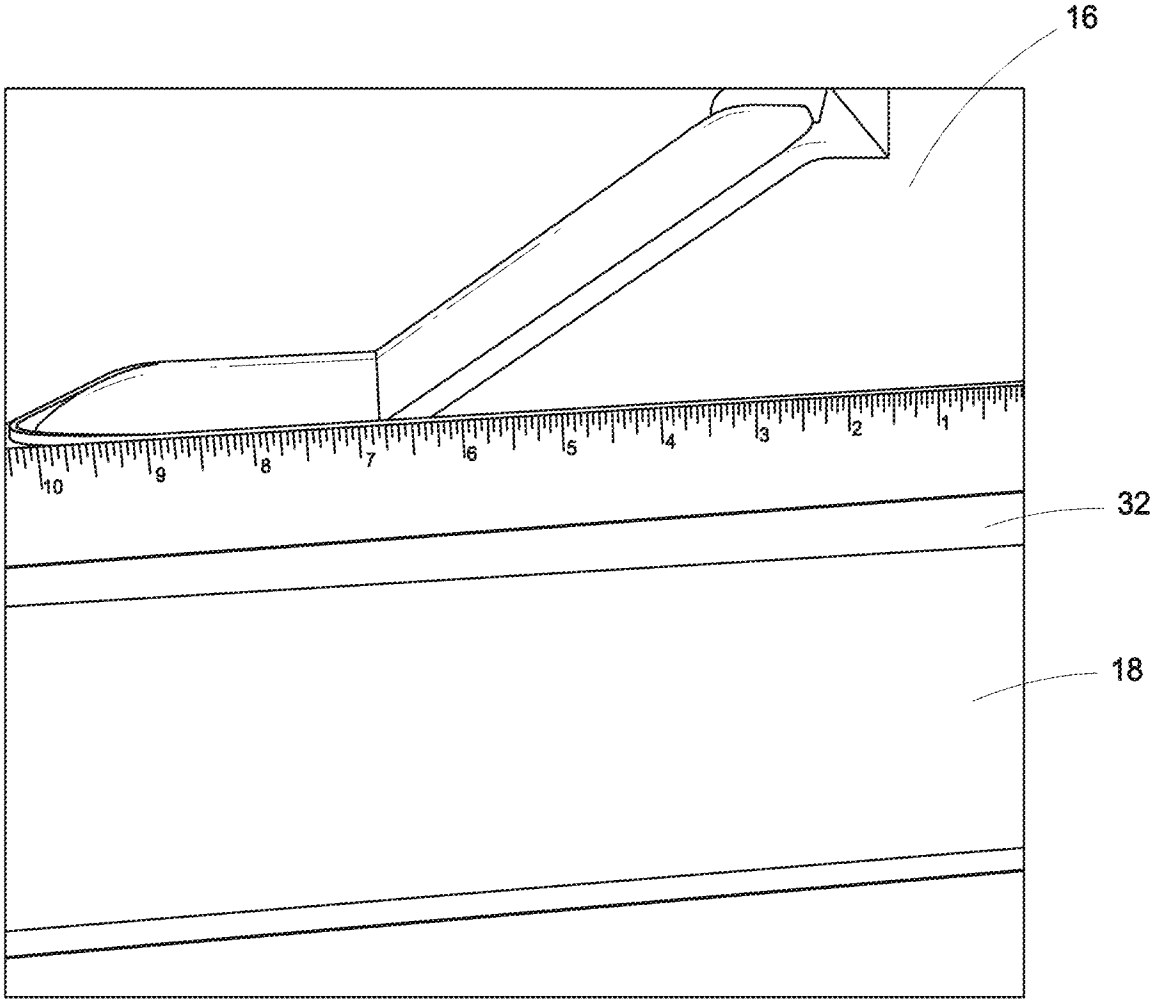
FIG. 4A is a depiction of a tunnel assembly and jet intake mount and jet intake according to an embodiment of the disclosure.
Figure 4B:
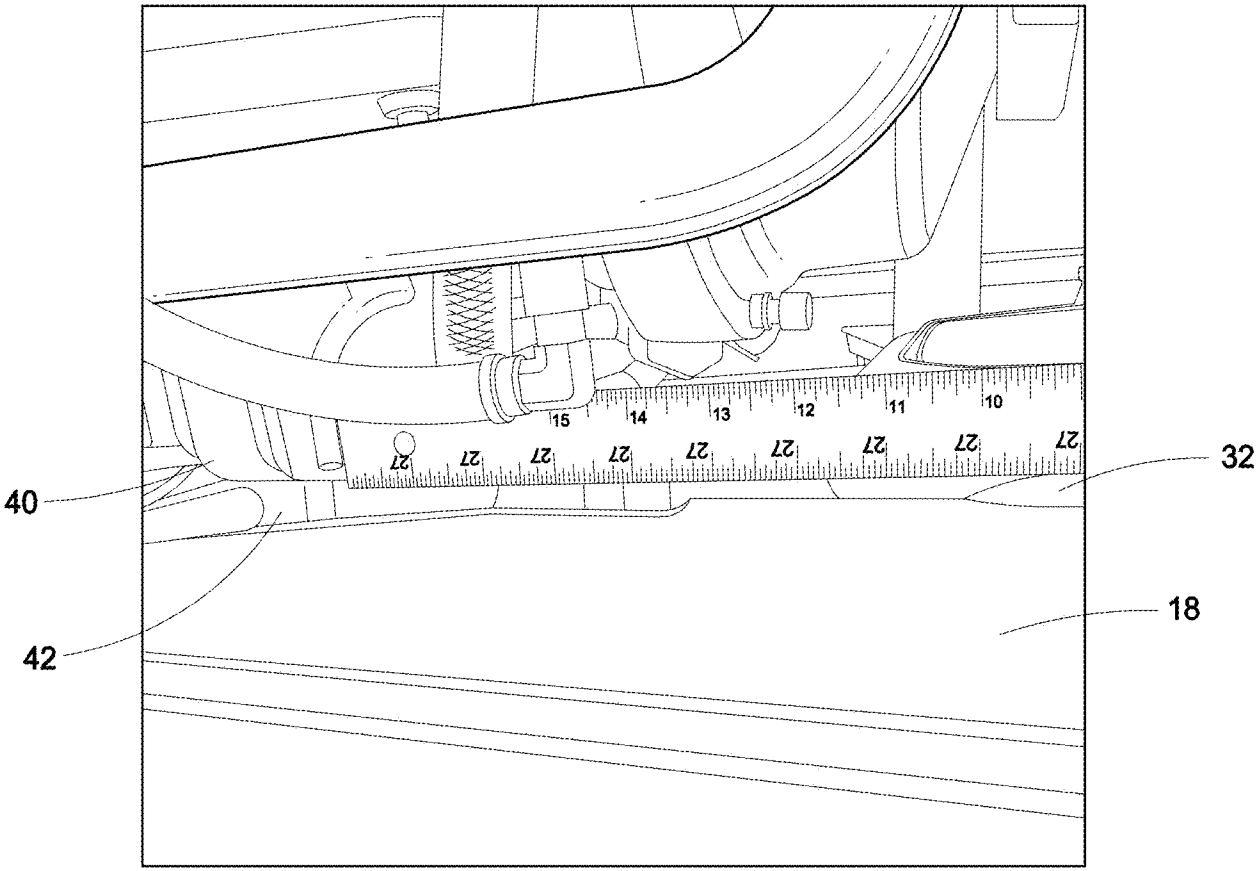
FIG. 4B is another depiction of another portion of the tunnel assembly and jet intake mount and jet intake as well as motor according to an embodiment of the disclosure.

Referring next to FIG. 2, a more particular emphasis on the engagement of the water intake 16 to mount 32 is shown. As shown, the water intake can have portions that are received by mount 32. In FIG. 3, it is shown that intake 16 is engaged with mount 32. In FIG. 4A, intake 16 is engaged with mount 32, which is also engaged with tunnel assembly 18. As shown in FIG. 4B, tunnel assembly 18 can include clearance space 42 for oil pan 40 of a motor.

Figure 5:
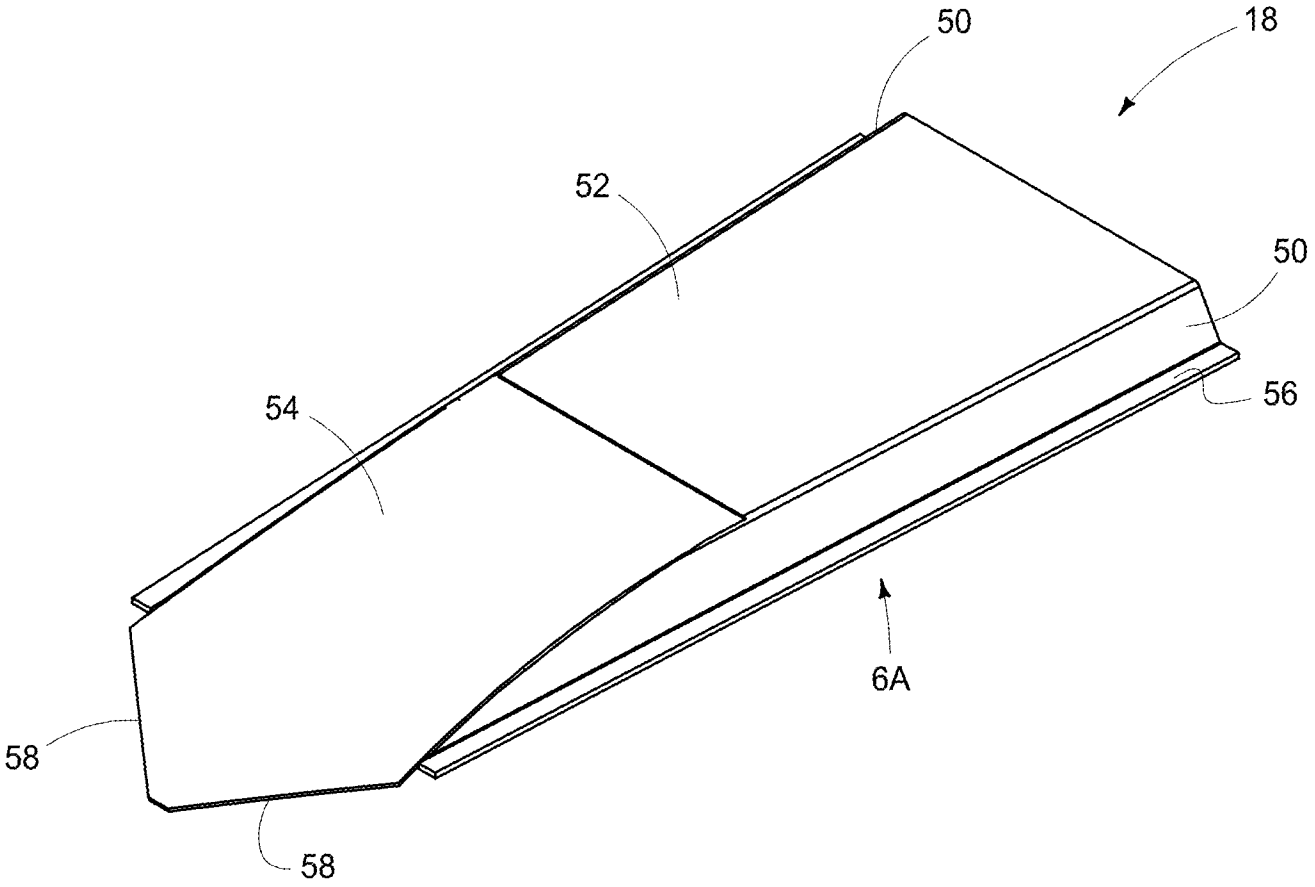
FIG. 5 is a depiction of a tunnel assembly according to an embodiment of the disclosure.
Figure 6A:
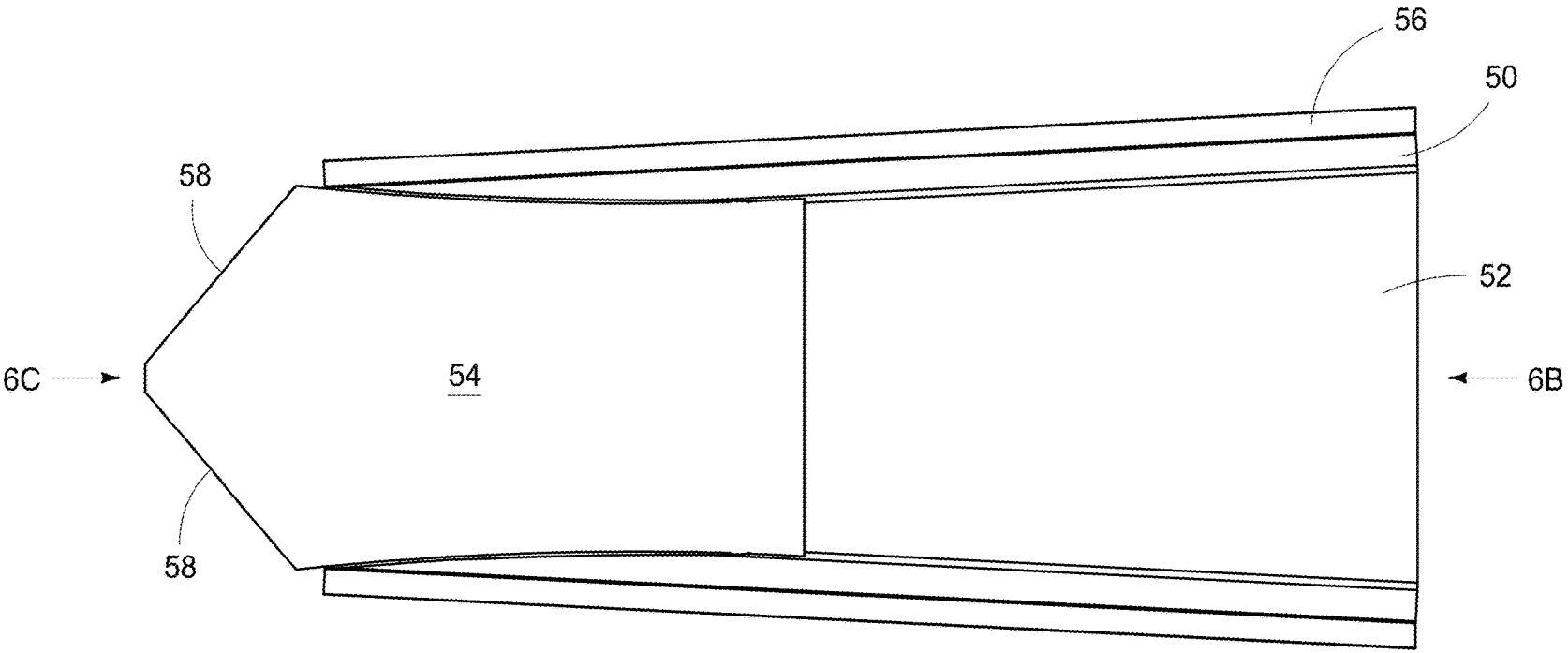
FIGS. 6A-6C are depictions of the tunnel assembly of FIG. 5 according to an embodiment of the disclosure.
Figure 6C:
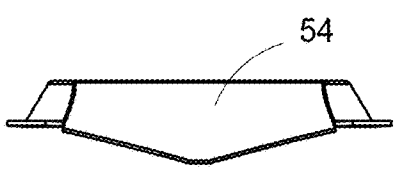
Figure 6B:
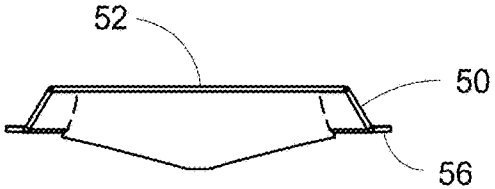

Referring next to FIG. 5, in more detail tunnel assembly 18 is shown which includes a mount support 52 that is supported by sidewalls 50 which are engaged with flanges 56. In accordance with example implementations, motor ramp 54 can be rounded and/or provide a relief for a motor oil pan that is operably engaged with the intake not shown. In accordance with example implementations, ramp 54 can include beveled edges 58 which are so beveled to operably engage and meld with hull 20 of the watercraft. As shown in FIG. 5, a view 6A is provided which is a lower view of tunnel assembly 18. As shown in FIGS. 6A, views 6B and 6C are provided that demonstrate the stern and bow views of tunnel assembly 18.

Figure 7:
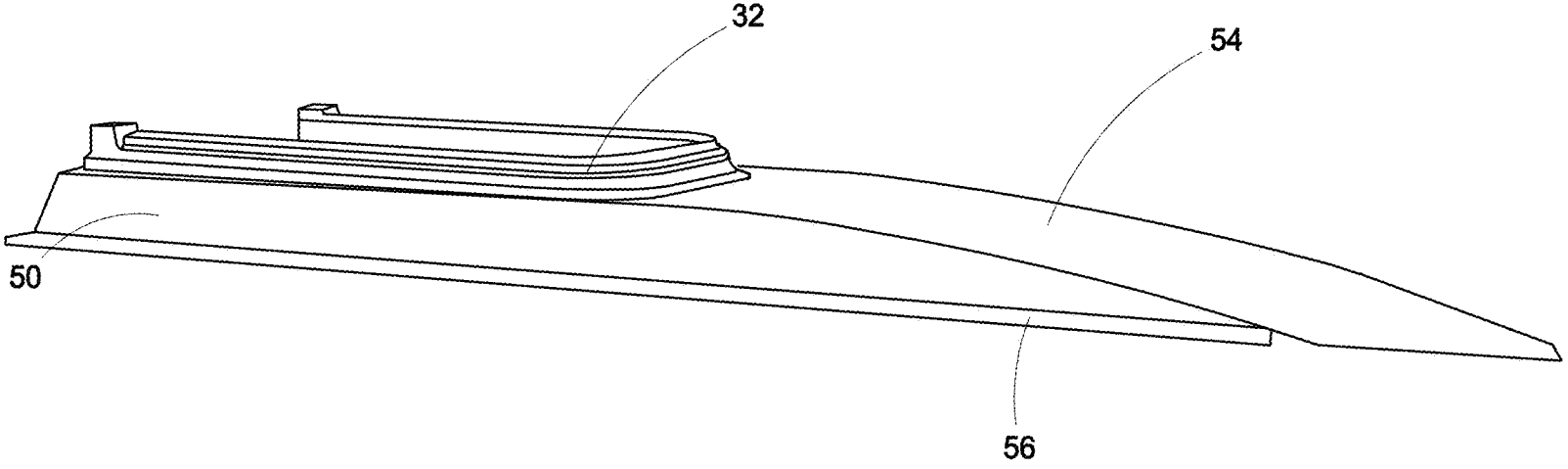
FIG. 7 is another depiction of the tunnel assembly of FIG. 5 and FIG. 6 as well as jet intake mount according to an embodiment of the disclosure.
Figure 8:
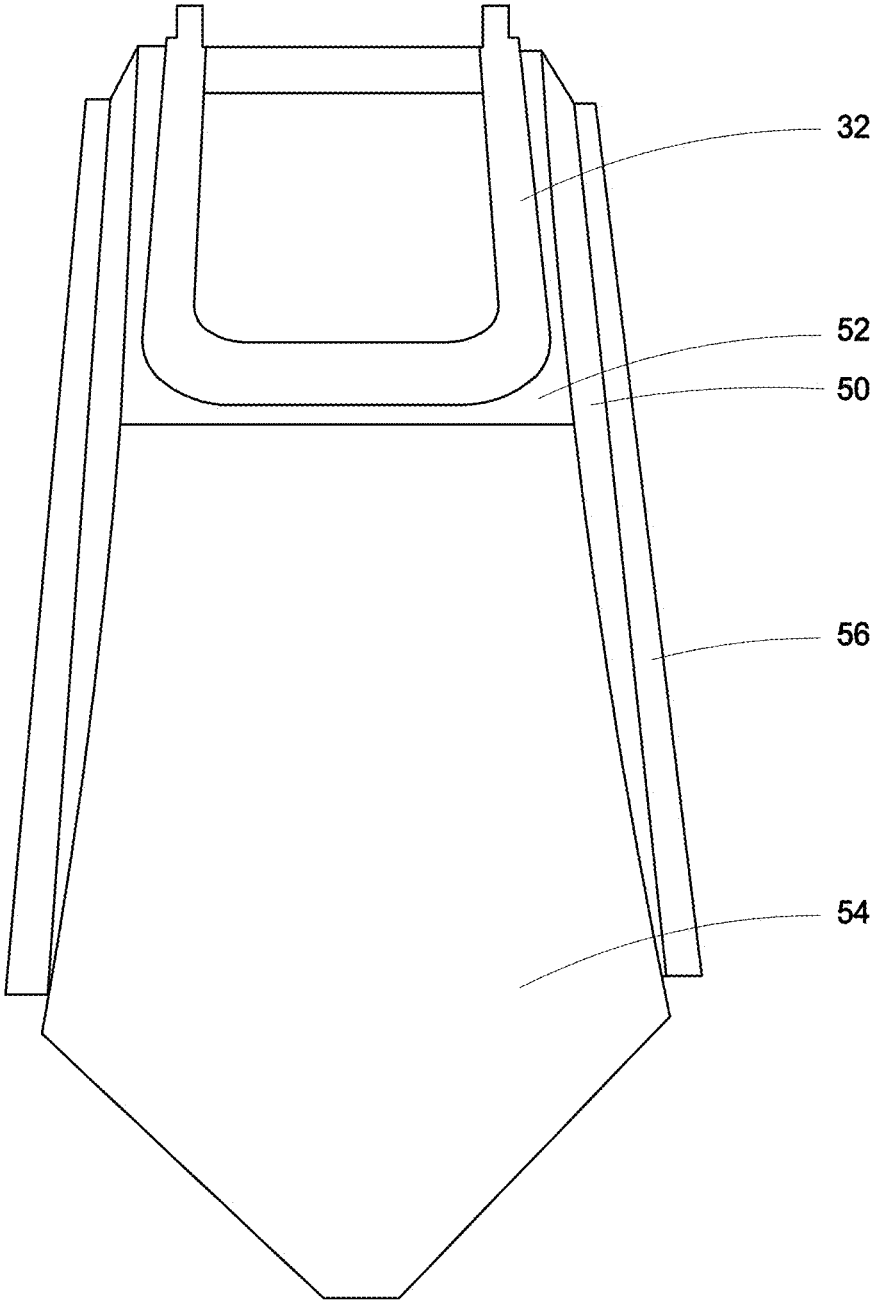
FIG. 8 is another view of the tunnel assembly and jet intake mount of FIG. 7 according to an embodiment of the disclosure.
Figure 9:
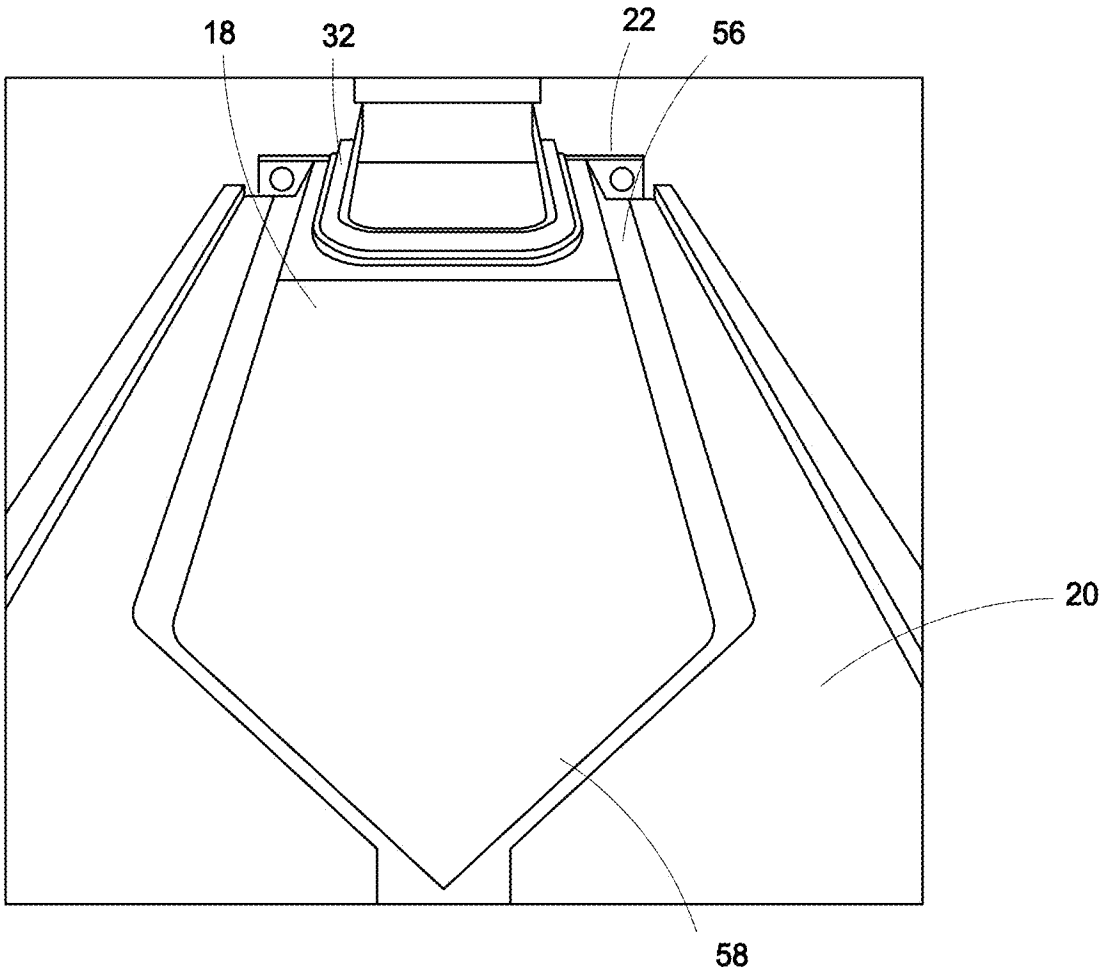
FIG. 9 is a depiction of the tunnel assembly jet intake mount as incorporated into a hull of a boat according to an embodiment of the disclosure.
Figure 10A:
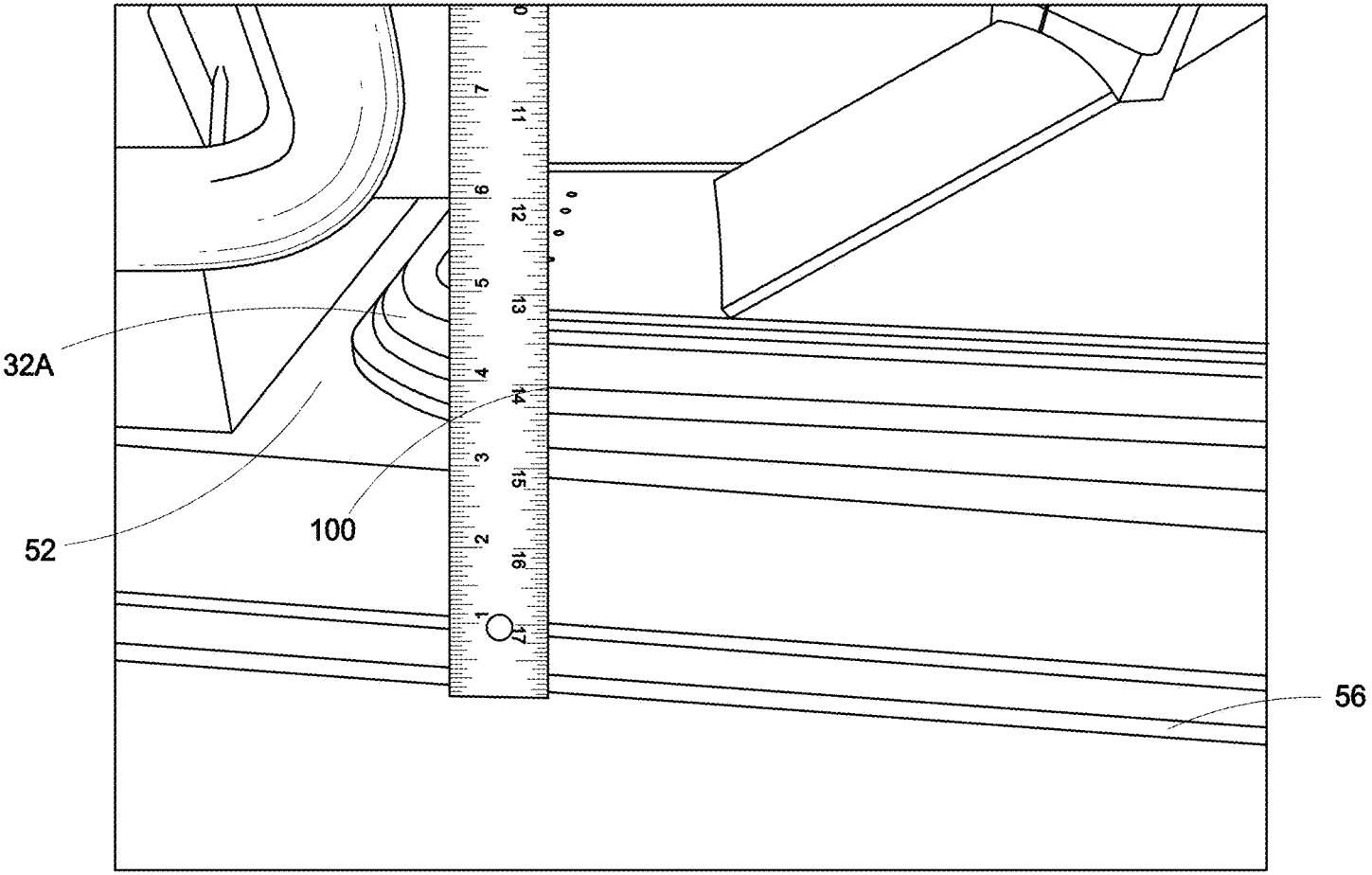
FIG. 10A is a depiction of the engagement of the jet intake mount and the tunnel assembly according to an embodiment of the disclosure.
Figure 10B:
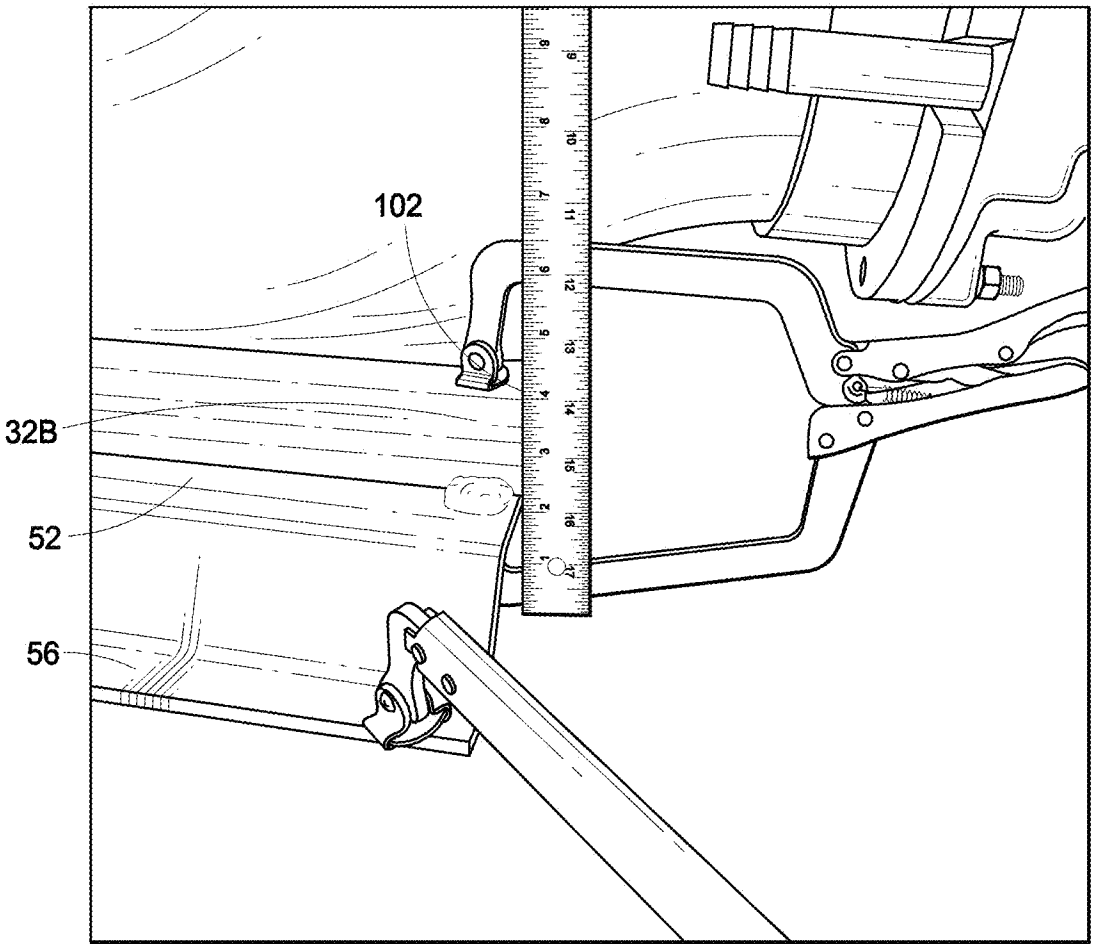
FIG. 10B is another depiction of another portion of the same engagement according to an embodiment of the disclosure.

Referring next to FIG. 7, tunnel assembly 18 is shown engaged with mount 32, and also in another view in FIG. 8, tunnel assembly 18 is shown. In FIG. 9, tunnel assembly 18 is shown engaged with hull 20. As shown, bevels 58 conform to hull floor 20, and flanges 56 engage with hull floor 20 as well. Accordingly, tunnel assembly 18 engages with stern 22. Referring next to FIG. 10A, the coupling portion between tunnel assembly 18 and bevel 32A is shown, wherein in a bow portion of the coupling of mount 32A, the distance between mount 32A and plate 52 is a first distance 100 as shown. As depicted in FIG. 10B, the distance between mount 32B and plate 52 is a second distance 102. In accordance with example implementations, the second distance is larger than the first distance, thereby giving a slight rise in relationship of mount 32 in relation to tunnel assembly 18 as mount 32 approaches and eventually terminates at stern 22 of the watercraft.

Figure 11:
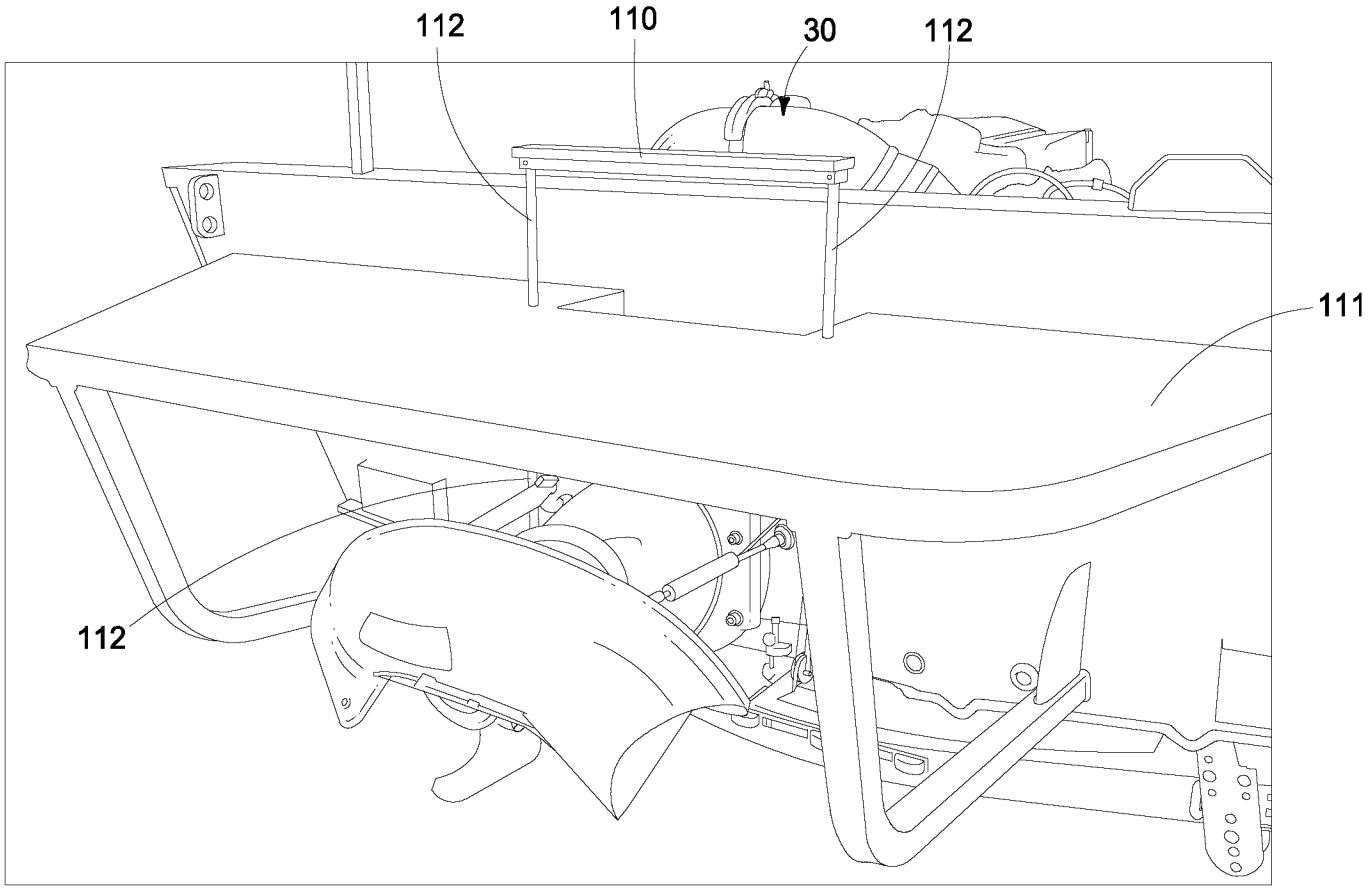
FIG. 11 is a depiction of a stern of a watercraft utilizing the stomp grate and tunnel assembly according to an embodiment of the disclosure.

Referring next to FIG. 11, a stern view of the watercraft is shown that includes a stomp plate 110 extending to stomp rods (push rods) 112 through a stern platform 111. In accordance with example implementations, stomp plate 110 and stomp rods 112 are portions of the degree or stomp clearance assembly 30.

Figure 12:
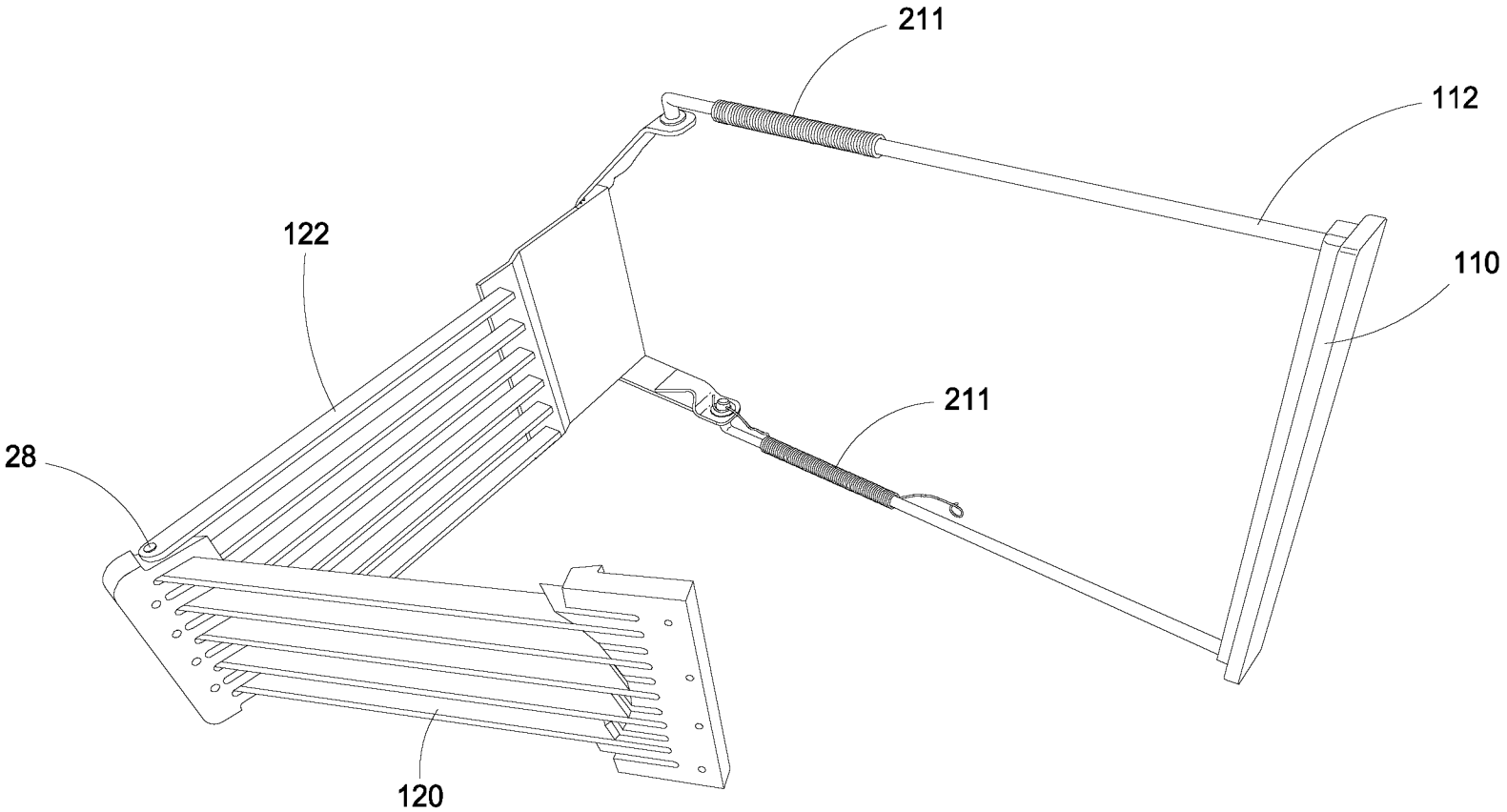
FIG. 12 is a depiction of the stomp grate assembly according to an embodiment of the disclosure.
Figure 13:
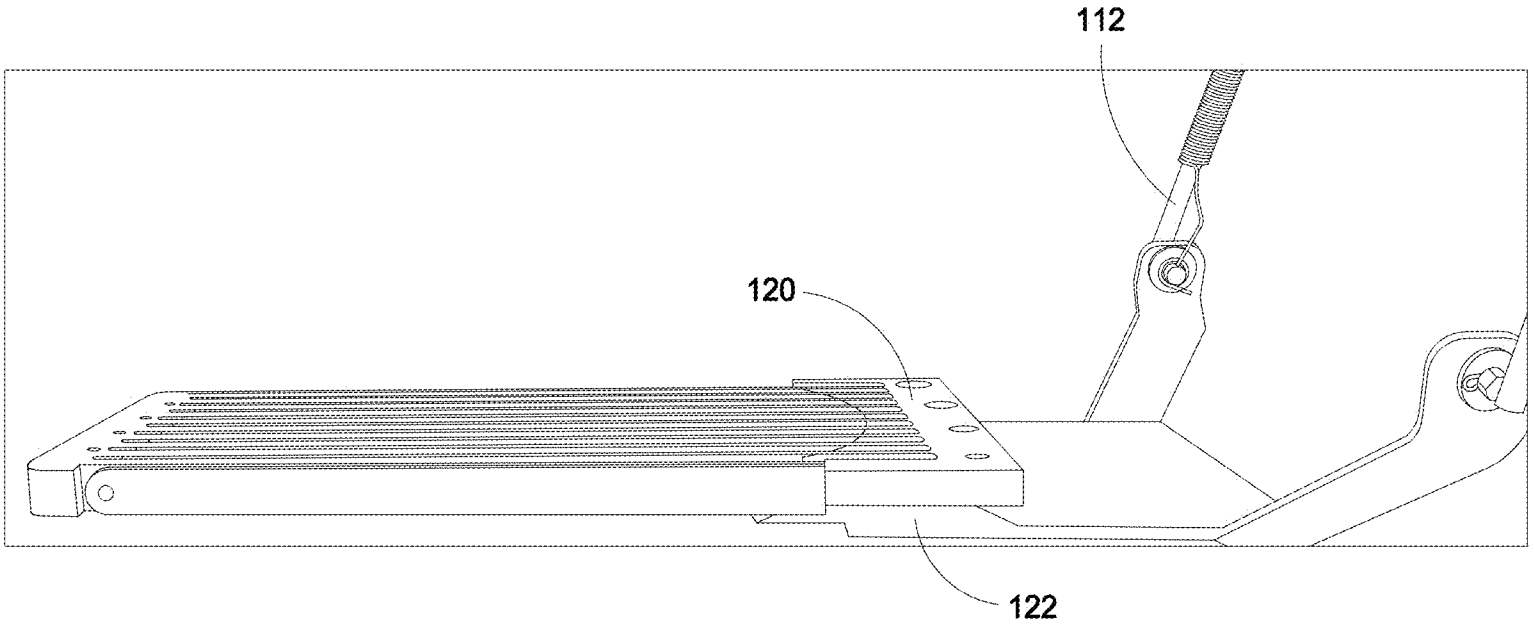
FIG. 13 is a depiction of components of the stomp grate assembly according to an embodiment of the disclosure.
Figure 14:
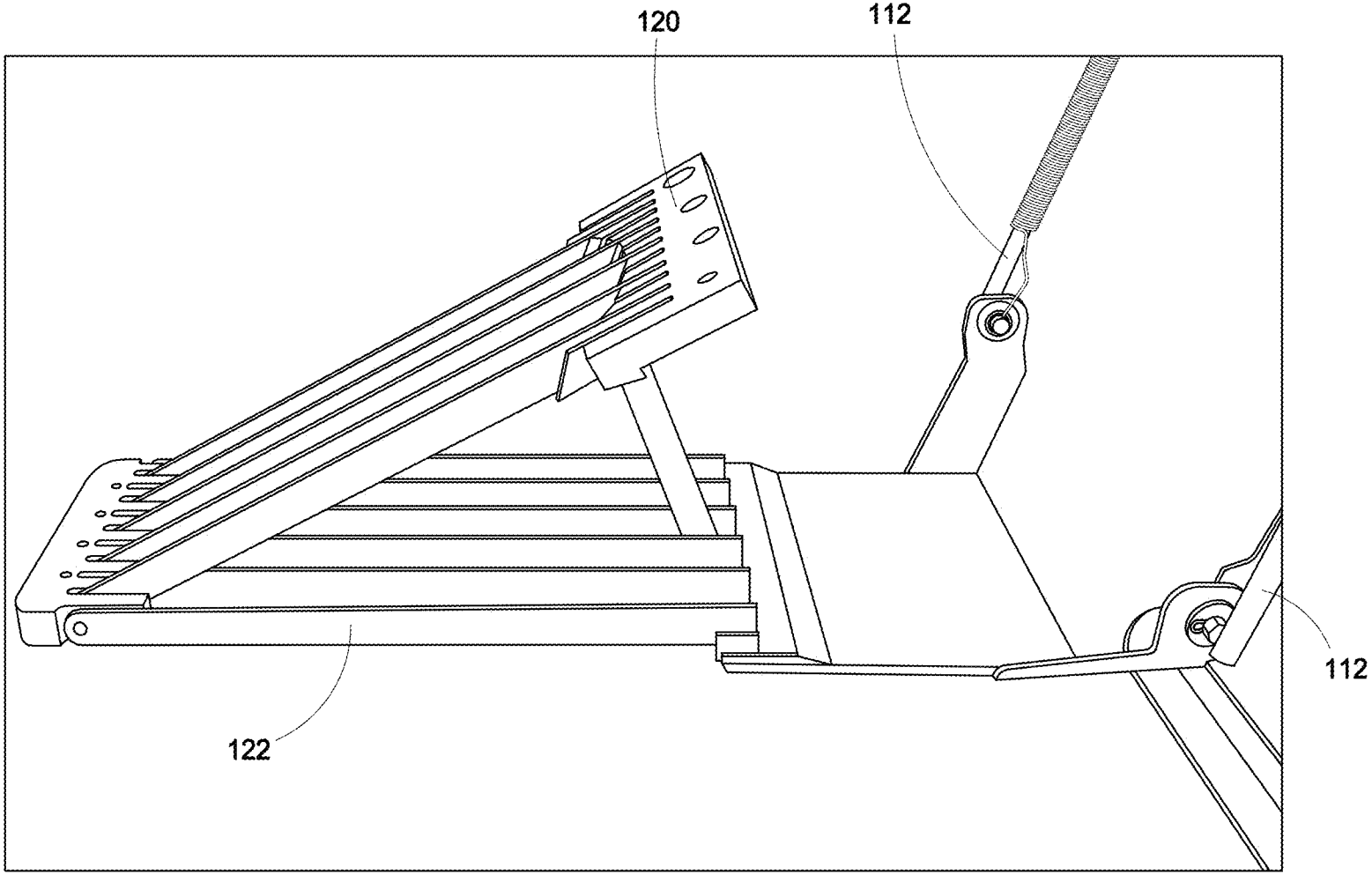
FIG. 14 is a depiction of the stomp grate assembly depicting components of same in relation to one another according to an embodiment of the disclosure.

Referring next to FIG. 12, a more detailed view of the stomp clearance assembly 30 is shown where stomp plate 110 is operatively engaged with rods 112 which operably engage with moveable grate 122 via pivot point 28 to fixed grate 120. In accordance with example implementations, fixed grate 120 and moveable grate 122 may be nested in the running position as shown in FIG. 13. In accordance with example implementations, as shown in FIG. 14, fixed grate 120 is shown in relation to moveable grate 122 as engaged with rods 112 of the stomp grate assembly.

Figure 15:
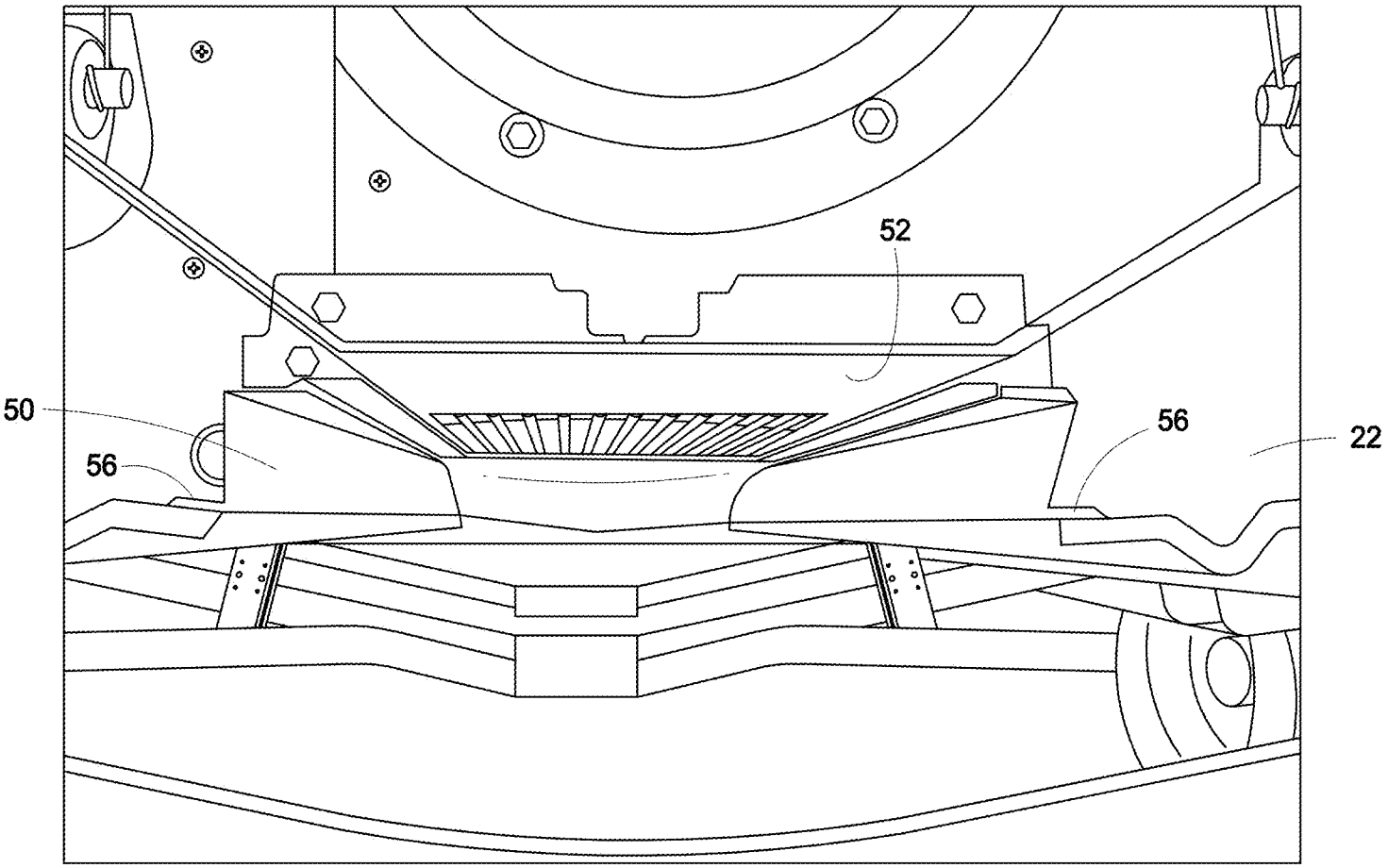
FIG. 15 is a depiction of the tunnel assembly according to an embodiment of the disclosure.
Figure 16A:
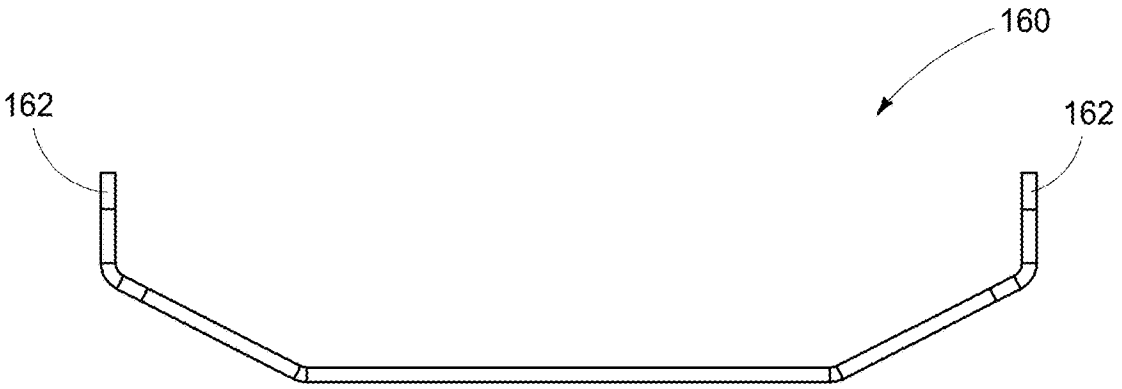
FIGS. 16A-16C are depictions of a component of the stomp grate assembly according to an embodiment of the disclosure.
Figure 16B:
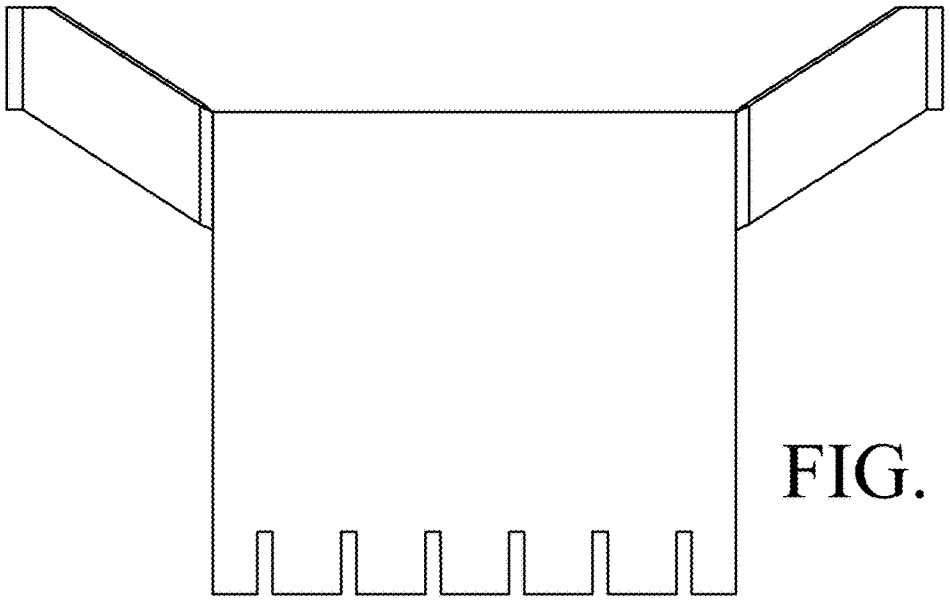
Figure 16C:
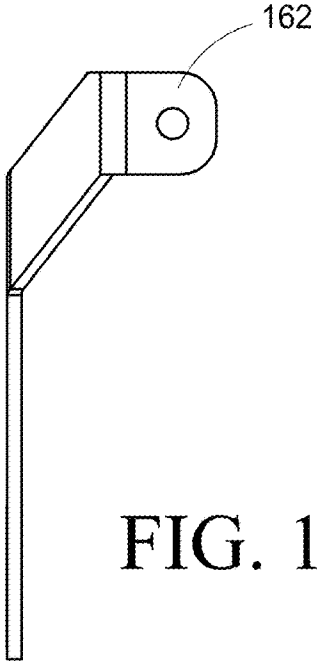
Figure 17:
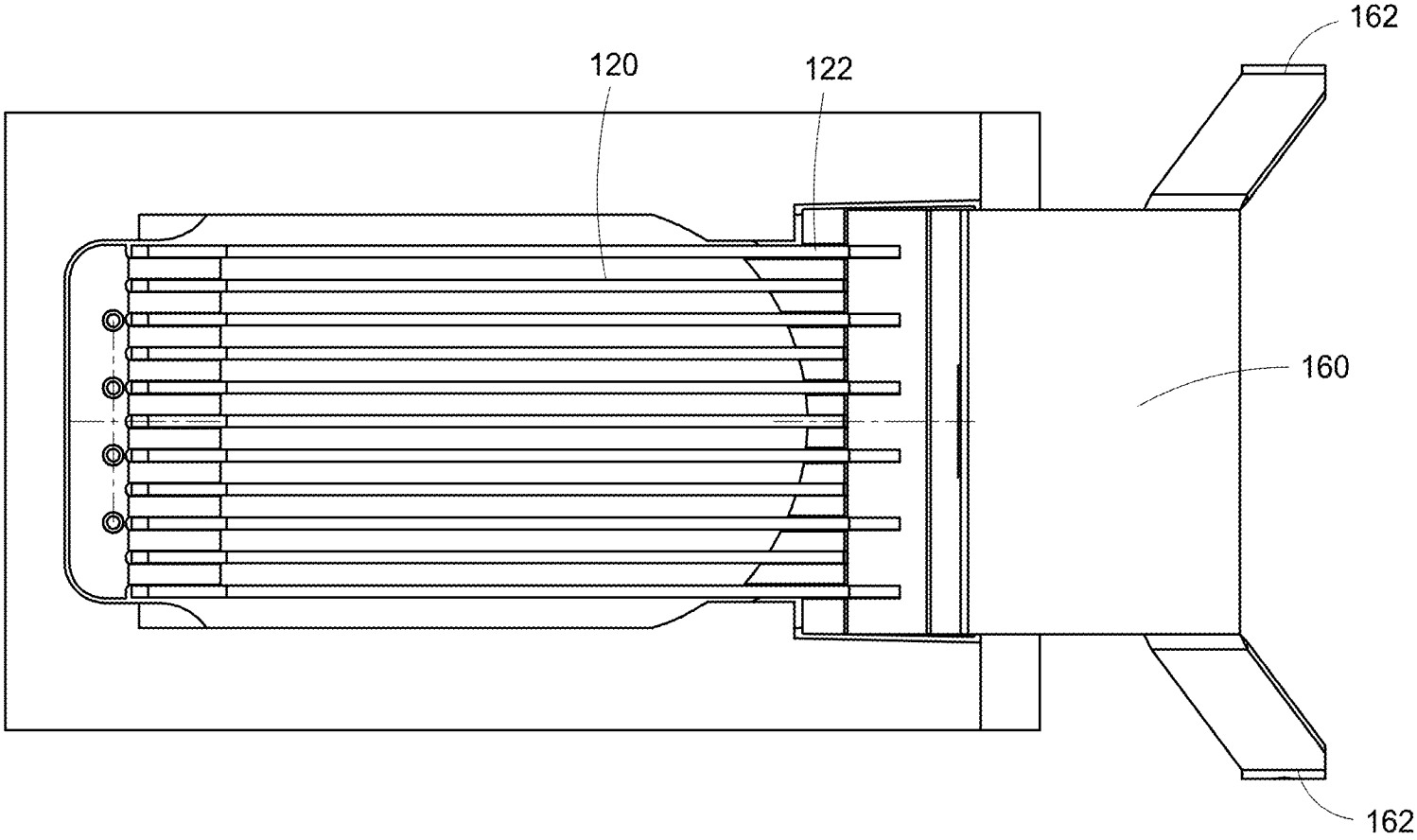
FIG. 17 is a depiction of the stomp grate assembly as viewed from underneath the hull of a watercraft according to an embodiment of the disclosure.

Referring next to FIG. 15, an installed tunnel assembly is shown as installed into the watercraft from a stern view 22. In accordance with example implementations, flanges 56 can engage and form part of hull 22 wherein a top grate 52 can be aligned to engage with grate portions in an open position as shown. Referring to FIGS. 16A-16C, more detailed views of the ride plate 160 which is the very end of the stomp grate assembly is shown that includes coupling portions 162 to engage rods 112 of the stomp grate assembly. In FIG. 17, a bottom view of the stomp grate assembly is shown, with ride plate 160 engaging moveable grate portions 122 which are nested with grate portions 120. Constructions of the materials above can be made with most materials suitable for the construction. Accordingly, steel, stainless steel, and/or aluminum components can be fabricated and welded to form the structures described herein.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect.

The invention claimed is:

1. A watercraft water propulsion motor intake clearing method, the method comprising:

extending push rods through a stern platform to extend a hinged grate away from the water propulsion motor intake;

biasing the hinged grate in a first position against the hull and about the intake;

extending the push rods to move the hinged grate to a second position away from the intake extending the push rods against a biasing member to extend the hinged grate; and wherein the push rods are operably engaged with a pedal and configured to be foot-operable.

2. The method of claim 1 wherein in the first position, the hinged grate meshes with an unhinged grate.

3. The method of claim 2 wherein in the second position, the hinged grate is at least partially removed from the unhinged grate.

4. The method of claim 1 further comprising a ride plate operably engaged between the hinged grate and the push rods.

5. The method of claim 4 further comprising transferring debris along the ride plate with operating the hinged grate.

6. The method of claim 1 wherein the hinged grate comprises a pair of opposing flanges that operably align with the contour of the boat hull.

7. The method of claim 6 wherein each flange is operably engaged with a push rod.

* * * * *